US007744200B2

(12) United States Patent
Nishida

(10) Patent No.: US 7,744,200 B2
(45) Date of Patent: Jun. 29, 2010

(54) INKJET PRINTER AND CONTROL METHOD THEREOF

(75) Inventor: Katsunori Nishida, Aichi-ken (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 758 days.

(21) Appl. No.: 11/586,020

(22) Filed: Oct. 24, 2006

(65) Prior Publication Data

US 2007/0115317 A1 May 24, 2007

(30) Foreign Application Priority Data

Nov. 24, 2005 (JP) ..... 2005-338024

(51) Int. Cl.
*B41J 2/175* (2006.01)

(52) U.S. Cl. ..... 347/85; 347/84

(58) Field of Classification Search ..... 347/5, 347/7, 84, 85

See application file for complete search history.

(56) References Cited

U.S. PATENT DOCUMENTS 4,558,326 A * 12/1985 Kimura et al. ..... 347/30
5,485,187 A * 1/1996 Okamura et al. ..... 347/85
6,030,074 A * 2/2000 Barinaga ..... 347/85
6,116,723 A * 9/2000 Childers ..... 347/85
6,281,916 B1 * 8/2001 VanSteenkiste ..... 347/85
6,840,604 B2 * 1/2005 Kimura et al. ..... 347/85
6,991,313 B2 1/2006 Sasa

FOREIGN PATENT DOCUMENTS

JP 10-138506 5/1998
JP 2004-58348 2/2004

* cited by examiner

*Primary Examiner*—Anh T. N. Vo
(74) *Attorney, Agent, or Firm*—Frommer Lawrence & Haug LLP

(57) ABSTRACT

An inkjet printer includes a print head having a plurality of nozzles; a plurality of ink cartridges storing inks of different colors, respectively, to be supplied to the print head; and a pressure applying section for applying pressure in an ejecting direction to the inks in the nozzles of the print head by supplying compressed air to the ink cartridges, and the pressure applying section has a pump for supplying compressed air to the ink cartridges through an air channel provided between the ink cartridges and said pump; and a charge tank provided in the air channel, for temporarily keeping the compressed air, and, after increasing the pressure in the ink cartridges, charge tank and air channel by the supply of compressed air from the pump, the compressed air is released to the print head and the pressure is applied to the inks in the nozzles of the print head.

12 Claims, 7 Drawing Sheets

INKJET PRINTER AND CONTROL METHOD THEREOF

CROSS-REFERENCE TO RELATED APPLICATIONS

This non-provisional application claims priority under 35 U.S.C. §119(a) on Patent Application No. 2005-338024 filed in Japan on Nov. 24, 2005, the entire contents of which are hereby incorporated by reference.

BACKGROUND

The present invention relates to an inkjet printer and a method of controlling the inkjet printer.

For example, an inkjet printer having the structure shown in FIG. 1 is conventionally known as an inkjet printer that performs positive pressure purging by causing compressed air generated by an air pump to act on the ink in an ink cartridge. Specifically, a head holder 101 is arranged so that it is movable in a reciprocating manner in a direction orthogonal to a direction of feeding recording paper A, and a print head 101A comprising a number of nozzles arranged in a plurality of lines is installed in the head holder 101. A plurality of ink cartridges 102M, 102C, 102B, and 102Y storing inks to be supplied to the print head 101A are provided, and also a plurality of pressure applying valves 103M, 103C, 103B, and 103Y are provided between the print head 101A and the respective ink cartridges 102M, 102C, 102B, and 102Y. A charge tank 105 for temporarily keeping the compressed air is provided between an air pump 104 and the ink cartridges 102M, 102C, 102B, and 102Y An atmospheric air release valve 107 is provided in an air channel 106 between the charge tank 105 and the respective ink cartridges 102M, 102C, 102B and 102Y, and switching means 108 for switching the ink cartridges 102M, 102C, 102B and 102Y to supply the compressed air is provided between the charge tank 105 and the ink cartridges 102M, 102C, 102B and 102Y. In an inkjet printer thus constructed, positive pressure purging is performed sequentially for a plurality of ink cartridges 102M, 102C, 102B, and 102Y by switching the ink cartridges 102M, 102C, 102B and 102Y to be supplied with compressed air by the switching means 108 and opening the pressure applying valves 103M, 103C, 103B and 103Y corresponding to the ink cartridges 102M, 102C, 102B and 102Y. After purging, the air pump 104 is stopped, and the atmospheric air release valve 107 is opened to release the compressed air remaining in the charge tank 105 to the atmosphere.

Moreover, there was proposed an inkjet recording apparatus in which a print head and a sub-tank unit are mounted on a carriage, and an ink cartridge connected to the print head through an ink supply tube, an air pump for supplying compressed air to the ink cartridge, a pressure regulator, a switching valve, etc. are provided in a printer main body (main body frame). In such an inkjet recording apparatus, when the amount of ink remaining in the sub-tank is small, the switching valve is switched to connect the air pump and an ink bag of the ink cartridge together, and therefore the compressed air in the air pump is supplied to the ink bag through the pressure regulator and the switching valve, and the ink in the ink bag is fed to the ink head and the sub-tank (see, for example, Japanese Patent Application Laid-Open No. 10-138506 (1998)).

However, in the ink jet printer shown in FIG. 1 and the inkjet recording apparatus described in Japanese Patent Application Laid-Open No. 10-138506 (1998)) mentioned above; the atmospheric air release valve and the pressure regulator are positioned between the air pump and the ink cartridge, and an air pressure adjustment of the compressed air to be supplied from the air pump to the ink cartridge is performed by the atmospheric air release valve and the pressure regulator. Therefore, a space for installing the large atmospheric air release valve and pressure regulator is required, and consequently not only the size of he inkjet printer becomes bigger, but also the production cost increases. Further, since the amount of compressed air that can be supplied to each ink cartridge is defined by the capacity of the pressure regulator placed on the upstream side of the ink cartridge, there is a possibility that a pressure force to be applied to the print head may vary depending on the amount of ink remaining in the ink cartridge.

Therefore, in order to simply adjust the pressure of the compressed air at low cost, in a known apparatus, an air supply tube for supplying the air from the air pump to an air chamber of each ink cartridge has an orifice, and the pressure is adjusted by discharging the compressed air generated in the air pump by the orifice when performing purging (see, for example, Japanese Patent Application Laid-Open No. 2004-58348).

SUMMARY

In the apparatus disclosed in Japanese Patent Application Laid-Open No. 2004-58348, since the compressed air is supplied to the air chambers of four ink cartridges with a single air pump and the pressure is adjusted by the orifice, a large air pump and a large installation space are required.

Therefore, it is an object to provide an inkjet printer and a method of controlling the ink jet printer, which require no switching mechanism for switching valves and save space. Another object is to provide an inkjet printer and a method of controlling the inkjet printer, capable of performing purging with a desired pressure force regardless of the amount of remaining ink.

An inkjet printer according to a first aspect is characterized by comprising: a print head having a plurality of nozzles; a plurality of ink cartridges storing inks of different colors, respectively, to be supplied to the print head; and a pressure applying section for applying pressure in an ejecting direction to the inks in the nozzles of the print head by supplying compressed air to the ink cartridges, wherein the pressure applying section comprises a pump for supplying compressed air to the ink cartridges through an air channel provided between the ink cartridges and said pump, and a charge tank provided in the air channel, for temporarily keeping the compressed air, and, after increasing pressure in the ink cartridges, charge tank and air channel by the supply of compressed air from the pump, the pressure is applied to the inks in the nozzles of the print head by releasing the compressed air to the print head.

A control method of an inkjet printer according to a second aspect is a method of controlling an inkjet printer comprising a print head having a plurality of nozzles; a plurality of ink cartridges storing inks of different colors, respectively, to be supplied to the print head; a pump for supplying compressed air to the ink cartridges through an air channel provided between the ink cartridges and said pump; and a charge tank provided in the air channel, for temporarily keeping the compressed air, and characterized by comprising the steps of increasing pressure in the ink cartridges, the charge tank and the air channel by the supply of compressed air from the pump; and applying the pressure to the inks in the nozzles of the print head by releasing the compressed air to the print head.

Accordingly, not only the charge tank, but also the air channel between the pump and the ink cartridges can perform the function as the space for temporarily keeping the compressed air, and therefore it is possible to decrease the capacity of the charge tank, eliminate the necessity of a switching mechanism such as a switching valve, and save space. Moreover, it is possible to perform positive pressure purging with a desired pressure force regardless of the amount of remaining ink.

According to the first and second aspects, not only the charge tank for temporarily keeping the compressed air before applying the pressure to the inks in the nozzles of the print head, but also the air channel between the pump and the ink cartridges can perform the function as the space (charge tank) for temporarily keeping the compressed air, and therefore it is possible to decrease the capacity of the charge tank, eliminate the necessity of a switching mechanism such as a switching valve, and save space. Further, a desired pressure force can be applied to the print head regardless of the amount of ink remaining in the ink cartridges. It is thus possible to always perform stable purging.

The above and further objects and features will more fully be apparent from the following detailed description with accompanying drawings.

DETAILED DESCRIPTION OF THE EXEMPLARY EMBODIMENTS

The following description will explain an embodiment with reference to the drawings. This embodiment is applied to a multi-function device (MFD) 1 having a printer function, a copy function, a scanner function, and a facsimile function.

Figure 1:
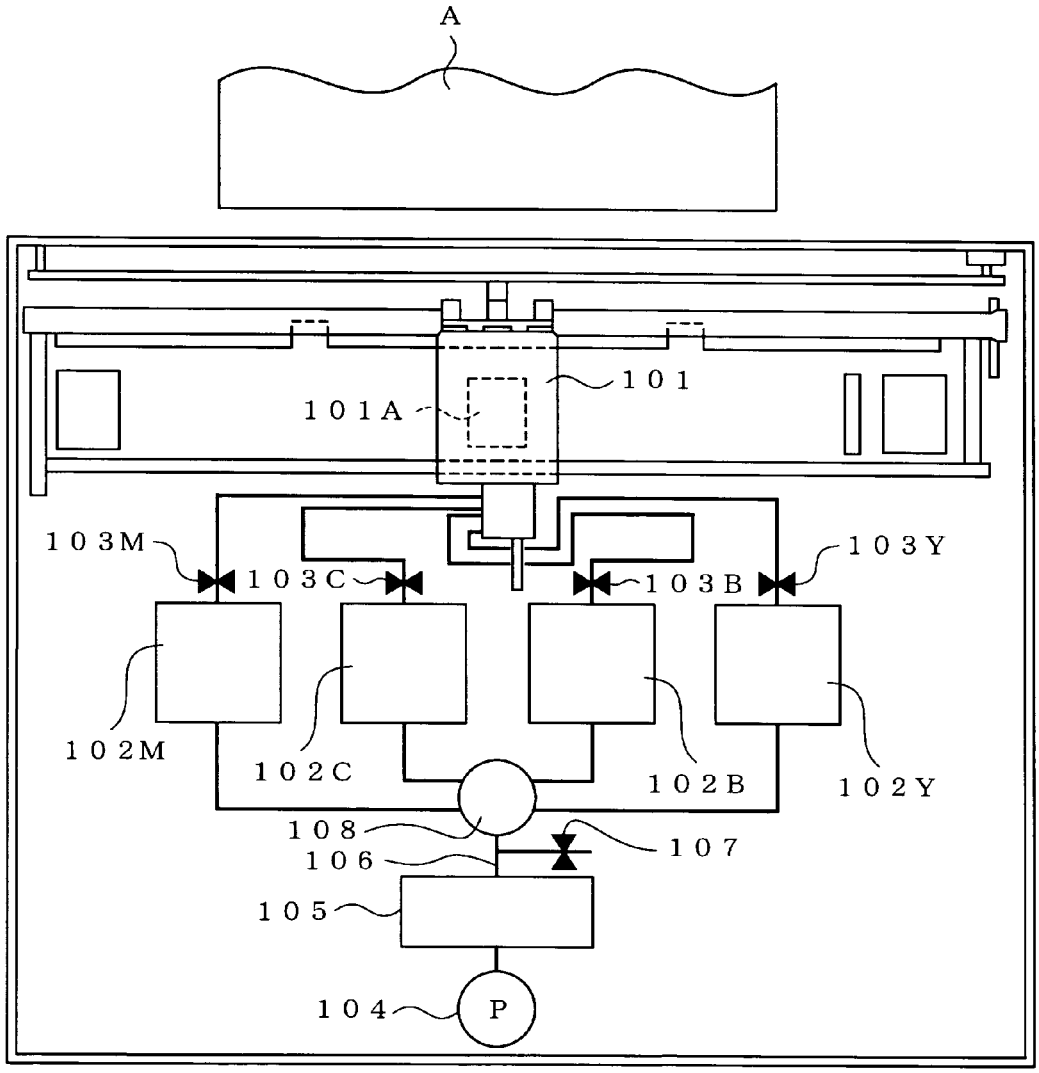
FIG. 1 PRIOR ART
FIG. 1 is a schematic structural view of an inkjet printer of a conventional example.
Figure 2:
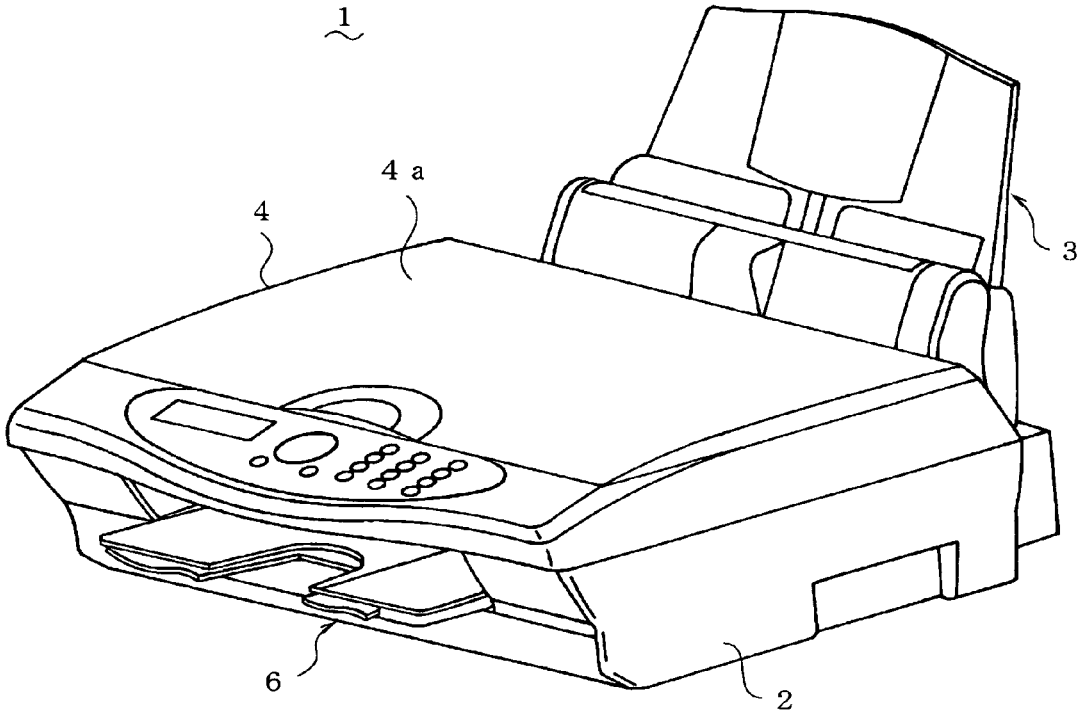
FIG. 2 is a perspective view of a multi-function device (MFD) using an inkjet printer according to an embodiment.
Figure 3:
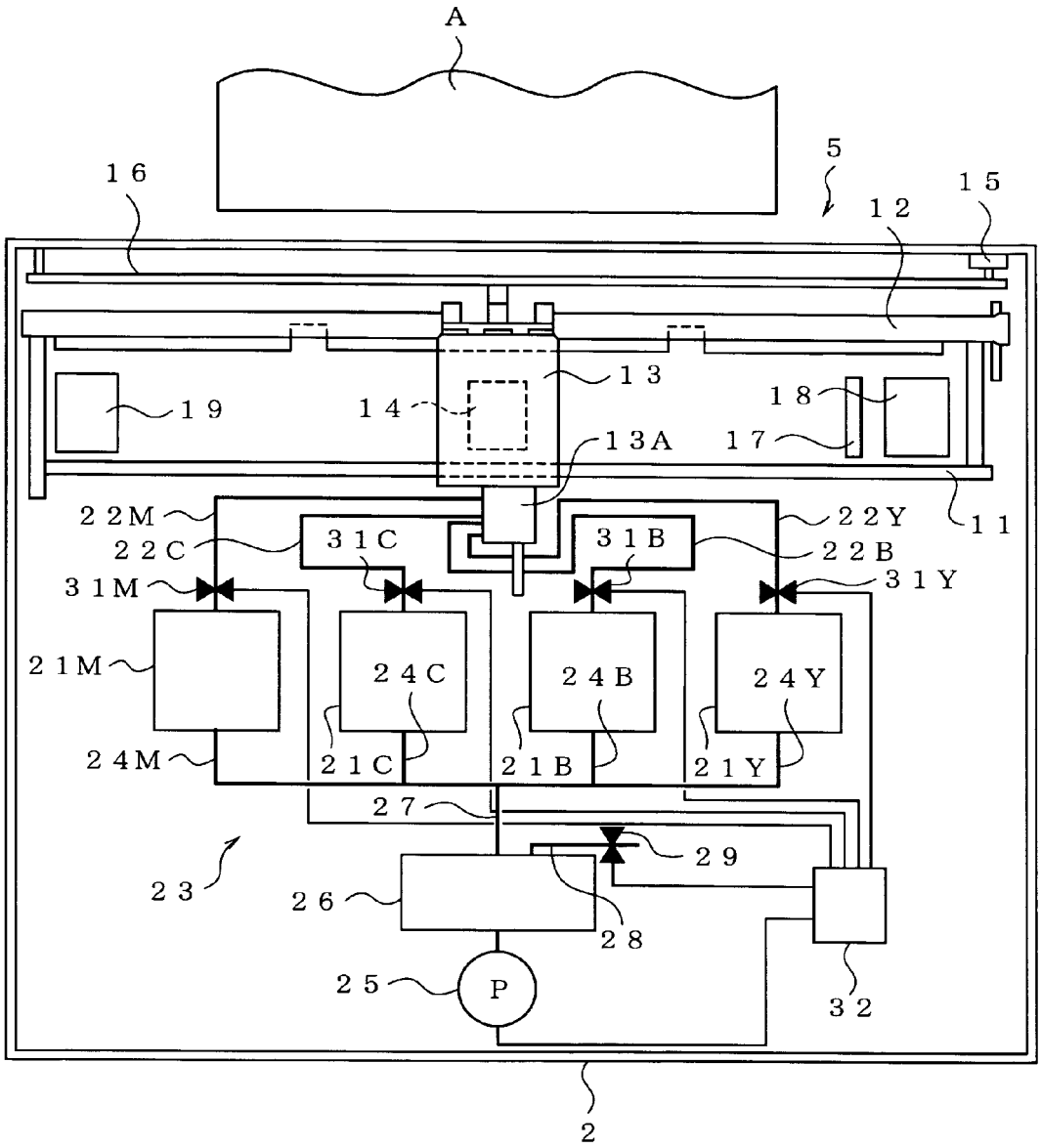
FIG. 3 is a schematic structural view of the inkjet printer.

FIG. 2 is a perspective view of a multi-function device (MFD) using an inkjet printer according to this embodiment, and FIG. 3 is a schematic structural view of the inkjet printer.

As shown in FIGS. 2 and 3, the multi-function device (MFD) 1 comprises a main body case 2, and a paper feeding device 3, mounted on the rear side of the main body case 2, for supplying recording paper A as a recording medium. The inside of the main body case 2 is separated into upper and lower sections according to the built-in functions. Placed on the upper side of the main body case 2 is a document reading device 4 for performing the copy function and facsimile function. An inkjet printer 5 for realizing the printer function is provided on the lower side of the main body case 2, that is, under the document reading device 4. Further, a paper discharge tray 6 for receiving recorded recording paper A is positioned on the front side of the main body case 2.

Although not shown specifically, the document reading device 4 is mounted with a horizontal axis at the rear side so that it can swing up and down, a placement glass plate for placing a document thereon is exposed when a cover body 4*a* is open upward, and an image scanner device for reading a document is located under the placement glass plate.

In the inkjet printer 5, two guide shafts 11 and 12 are arranged parallel to each other in the main body case 2, and a head holder 13 functioning as a carriage is movably mounted on the guide shafts 11 and 12. In the head holder 13, a print head 14 having a plurality of nozzles to perform recording by ejecting inks onto the recording paper A is mounted so that the nozzles face downward. The head holder 13 (print head 14) is attached to an endless belt 16 which is rotated by a motor 15, and moves reciprocally along the guide shafts 11 and 12 during a print operation when the motor 15 is driven.

Mounted on one side of a reciprocal movement path of the print head 14 are a wiper 17 for wiping a nozzle surface, on which the nozzles are formed, of the print head 14 and a flushing tank 18 for ejecting excess ink. Mounted on the other side is a cap 19 for covering the nozzle surface of the print head 14 during non-printing.

Moreover, provided at the center on the front side of the inkjet printer 5 are an ink cartridge 21M storing a magenta ink to be supplied to the print head 14, an ink cartridge 21C storing a cyan ink, an ink cartridge 21B storing a black ink, and an ink cartridge 21Y storing a yellow ink. The ink cartridges 21M, 21C, 21B, and 21Y are connected to a tube joint 13A of the head holder 13 through flexible ink tubes 22M, 22C, 22B, and 22Y functioning as ink channels. Furthers connected to the ink cartridges 21M, 21C, 21B, and 21Y is a pressure applying section 23 for applying pressure in an ejecting direction to the inks in the nozzles of the print head 14 by supplying compressed air.

The pressure applying section 23 has an air pump 25 (pump) for supplying compressed air through air channels 24M, 24C, 24B, 24Y, and 27 to the ink cartridges 21M, 21C, 21B, and 21Y. An upstream-side portion of the air channel 27 having a charge tank 26 in the middle is connected to the air pump 25. A downstream-side portion of the air channel 27 forks on the downstream side of the charge tank 26, and is joined to the respective air channels 24M, 24C, 24B, and 24Y. Therefore, it is possible to temporarily keep the compressed air in the charge tank 26 in the air channel 27 before applying pressure to the inks in the nozzles of the print head 14. In other words, the charge tank 26 is a compressed air storing tank shared by the respective ink cartridges 21M, 21C, 21B, and 21Y. Moreover, since the compressed air is also stored in the space created in the respective ink cartridges 21M, 21C, 21B, and 21Y by consumption of the inks in addition to the charge tank 26, it is possible to stably supply the compressed air at a predetermined pressure.

An atmospheric air release channel 28 connected to the charge tank 26 is provided with an atmospheric air release electromagnetic valve 29 (atmospheric air release valve). Pressure applying electromagnetic valves 31M, 31C, 31B and 31Y (pressure applying valves) are provided on the ink tubes 22M, 22C, 22B and 22Y on the immediate downstream of the ink cartridges 21M, 21C, 21B and 21Y. Therefore, the compressed air is retained between the air pump 25 and the pressure applying electromagnetic valves 31M, 31C, 31B, and 31Y.

Recovery control means 32 (controller) composed of a micro computer, for example, is provided to control the air pump 25, atmospheric air release electromagnetic valve 29, and pressure applying electromagnetic valves 31M, 31C, 31B and 31Y. With the recovery control means 32, the air pump 25 is driven and rotated for a certain time to increase the pressure in the charge tank 26, the air channels 24M, 24C, 24B, 24Y and 27, and the ink cartridges 21M, 21C, 21B and 21Y when performing positive pressure purging. In this embodiment, the air pump 25 is driven until reaching a preset pressure. Thereafter, by keeping the pressure applying electromagnetic valves 31M, 31C, 31B, and 31Y open for a certain time, the above-mentioned pressure is applied to the inks in the nozzles of the print head 14. At this time, even when the amount of remaining ink differs among the ink cartridges 21M, 21C, 21B and 21Y, the supplied pressure is always the set pressure. After elapse of the certain time, control is performed to open the atmospheric air release electromagnetic valve 29 and release the compressed air in the charge tank 26. Note that, if the purging process is performed for a nozzle corresponding to the ink of a selected color, all the pressure applying electromagnetic valves 31M, 31C, 31B and 31Y are opened during a flushing process following the purging process.

Thus, the pressure from the air pump 25 to the pressure applying electromagnetic valves 31M, 31C, 31B and 31Y is increased to a predetermined pressure, and then positive pressure purging for applying the above-mentioned pressure to the inks in the nozzles of the print head 14 by the compressed air from the charge tank 26 (the air channels 24M, 24C, 24B, 24Y and 27 and the ink cartridges 21M, 21C, 21B and 21Y) for a certain time is executed.

Figure 4:
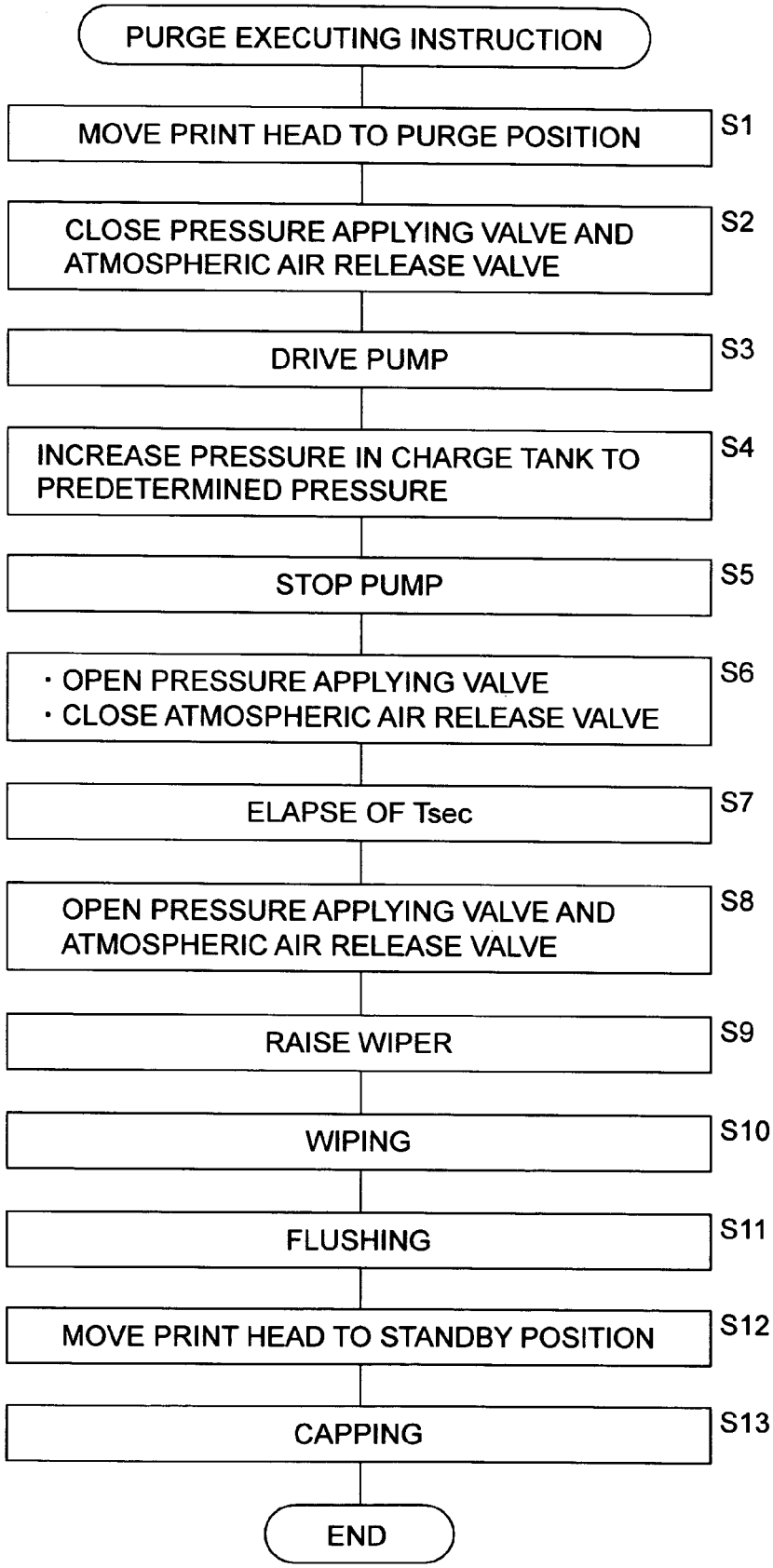
FIG. 4 is a flowchart showing one example of control.

Next, one example of control performed by the recovery control means 32 will be explained with reference to FIG. 4.

For example, when a purge executing instruction is inputted based on a program at the time printing is finished, the head holder 13 moves the print head 14 held thereon to a purge position facing the flushing tank 18 (step S1). Next, if the pressure applying electromagnetic valves 31M, 31C, 31B and 31Y and the atmospheric air release electromagnetic valve 29 are opened currently, they are closed, whereas if they are closed currently, the state is maintained (step S2). In this state, the air pump 25 is driven (step S3), and compressed air is supplied to the charge tank 26.

When the pressure in the charge tank 26 increases gradually and reaches a predetermined pressure with the supply of the air (step S4), the air pump 25 is stopped (step S5). After stopping the pump, the pressure applying electromagnetic valves 31M, 31C, 31B, and 31Y are opened (step S6) while maintaining the closed state of the atmospheric air release electromagnetic valve 29. The pressure is applied from the back side to the inks in the ink cartridges 21M, 21C, 21B and 21Y, and positive pressure purging for ejecting the inks from the nozzles to the flushing tank 18 is executed by the application of pressure. At this time, if positive pressure purging is to be performed only for the nozzle of a selected specific color ink, only the pressure applying electromagnetic valve corresponding to this nozzle is opened. On the other hand, if positive pressure purging is to be performed for all the nozzles of all color inks, all the pressure applying electromagnetic valves 31M, 31C, 31B and 31Y are opened.

After elapse of a certain time T sec (step S7), the atmospheric air release electromagnetic valve 29 is opened (step S8), the wiper 17 is raised (step S9), and a wiping operation is performed by the movement of the print head 14 (step S10). Here, it may be possible to apply the condition "after the air pump 25 is rotated a certain number of times" instead of "after elapse of a certain time T sec". Note that if positive pressure purging is to be performed for the nozzle of a specific color ink, the rest of the pressure applying electromagnetic valves remain closed. However, the pressure in the charge tank 26 returns to the atmospheric pressure during the wiping operation.

After finishing the wiping operation, if positive pressure purging is to be performed for a nozzle of a specific color ink, the rest of the pressure applying electromagnetic valves are opened at this stage, but, if positive pressure purging is to be performed for the nozzles of all the color inks, the operation proceeds to the next step. The print head 14 moves to the purge position again, and flushing is executed to prevent the colors of inks from being mixed together (step S11). Thereafter, the print head 14 moves to a standby position facing the cap 19 (step S12), the print head 14 is capped with the cap 19 (step S13), and the operation is finished.

In the above-described embodiment, it may be possible to make the following changes. Note that, in the explanation and drawings given below, structural elements similar to those in the above-described embodiment are designated with the same codes as in the above-described embodiment, and explanation thereof is omitted by referring to the above-described embodiment.

Figure 5:
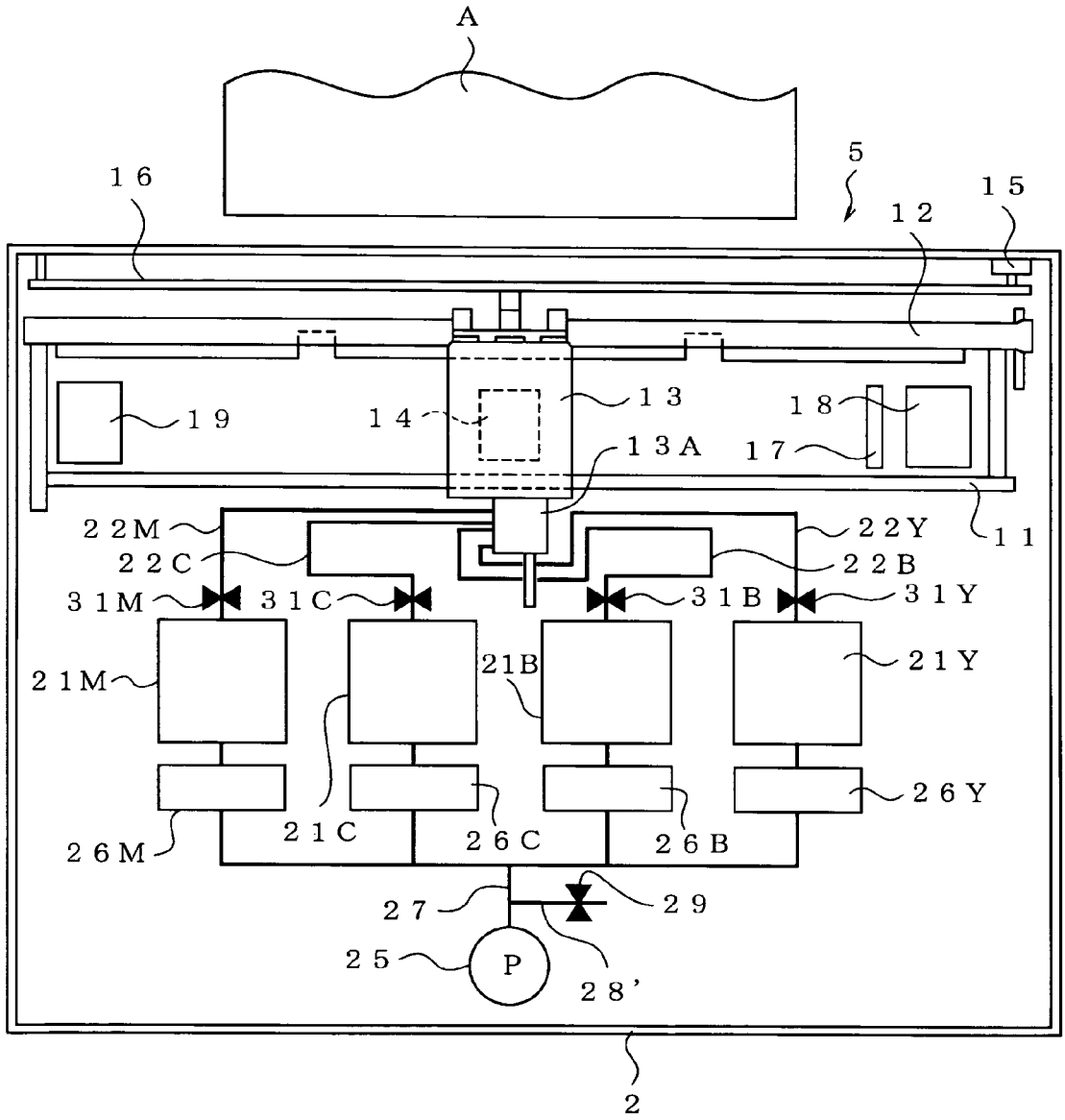
FIG. 5 is a view similar to FIG. 3, but showing another embodiment.

(i) In the above-described embodiment, although a single charge tank 26 is provided for all the ink cartridges 21M, 21C, 21B, and 21Y, it may be possible to provide a plurality of charge tanks 26M, 26C, 26B, and 26Y for the ink cartridges 21M, 21C, 21B, and 21Y, respectively, as shown in FIG. 5, for example. In this case, since there are four ink cartridges 21M, 21C, 21B, and 21Y, the tank capacity of each of the charge tanks 26M, 26C, 26B and 26Y is around one forth of the tank capacity of a single charge tank 26. An atmospheric air release channel 28' branches off from the air channel 27. It is thus possible to increase the degree of freedom in arranging the respective charge tanks 26M, 26C, 26B and 26Y, and contribute to size reduction.

Figure 6:
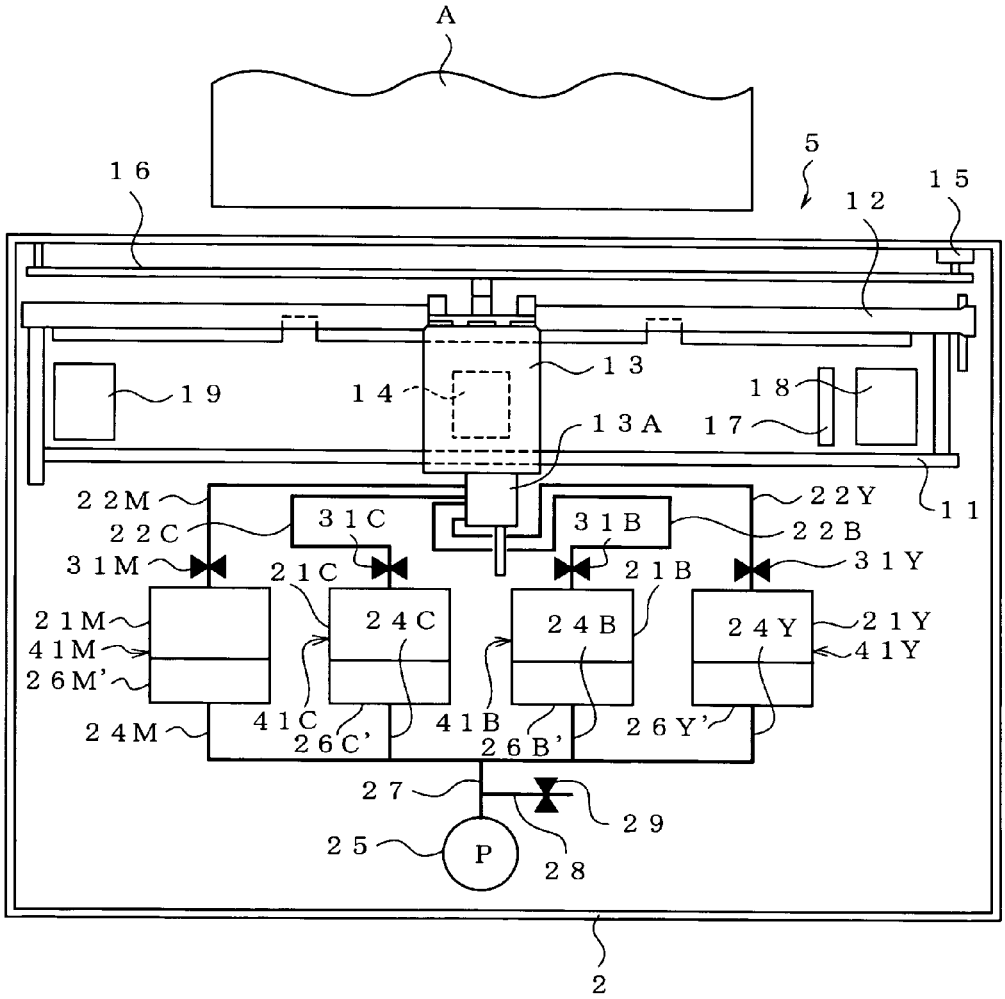
FIG. 6 is a view similar to FIG. 3, but showing still another embodiment.

(ii) It is not necessary to provide a charge tank independently for each of the ink cartridges 21M, 21C, 21B, and 21Y, and, for example, as shown in FIG. 6, it may be possible to construct charge tanks 26M', 26C', 26B'and 26Y' corresponding to the ink cartridges 21M, 21C, 21B, and 21Y, respectively, as air chambers integrally with casings 41M, 41C, 41B, and 41Y constituting the respective ink cartridges 21M, 21C, 21B, and 21Y. Accordingly, it is possible to simplify the arrangement of the air channel 27, and contribute to space saving. In addition, there is an advantage in terms of the number of parts.

Figure 7:
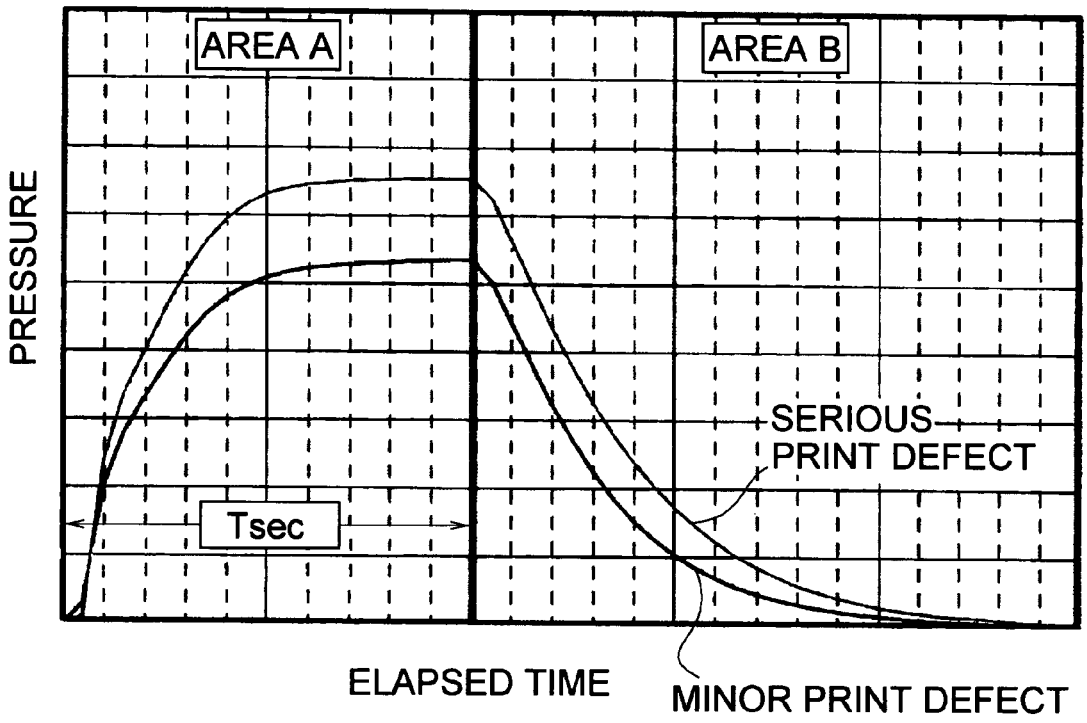
FIG. 7 is a view showing the relationship between elapsed time and a change in pressure.

(iii) In the above-described embodiment, although the recovery control means is constructed to apply uniform pressure (so-called charge pressure) to the inks in the nozzles of the print head, the recovery control means may control the pressure applying section according to the degree of print defect to change the magnitude of pressure to be applied to the inks in the nozzles of the print head. For example, as shown in FIG. 7, it may be possible to change pressure so that the pressure (so-called charge pressure) to be applied to the inks in the nozzles of the print head is higher in the case of serious print defect than in the case of minor print defect in an area A until T sec passes after opening the pressure applying electromagnetic valve. The reason for this is that, if pressure for charging has only a certain value when performing positive pressure purging after occurrence of print defect, the pressure acting on the print head is uniform regardless of the degree (minor or serious) of print defect, and therefore there is a possibility that the inks may be consumed wastefully.

Here, in order to determine whether the print defect is serious or minor, the user may determine whether the print defect is serious or minor based on a print result and input a signal by using a manual switch, or he/she may photograph the recorded recording paper with imaging means such as a CCD camera, use a method known for image processing to determine whether the print defect is serious or minor, and input a signal.

In this case, the recovery control means may change the magnitude of pressure by changing the amount of compressed air to be kept in the charge tank, or by changing the length of the air channel.

(iv) Each of the charge tanks may be constructed so that the tank capacity is set according to the flow resistance in the air channel corresponding to each charge tank. In other words, the charge tank corresponding to the air channel with a high flow resistance has a small tank capacity to facilitate the increase in the air pressure, while the charge tank corresponding to the air channel with a low flow resistance has a large capacity to slow the increase in the air pressure. Thus, for all the colors, the charge tanks can have a set internal pressure value at substantially the same time.

(v) In the above-described embodiment, although all the pressure applying electromagnetic valves 31M, 31C, 31B, and 31Y are opened and positive pressure purging is performed simultaneously for the nozzles of all the colors if positive pressure purging is to be performed for the nozzles of all the colors, it may be possible to execute positive pressure purging for the nozzles of all the color inks by opening the pressure applying electromagnetic valves 31M, 31C, 31B, and 31Y one by one and performing positive pressure purging sequentially for each of the nozzles of the color inks.

(vi) Although the above-described embodiment is applied to an inkjet printer of a multi-function device (MFD), the embodiment is also applicable to an ordinary inkjet printer. In this case, a personal computer connected to the inkjet printer comprises recovery control means.

According to this embodiment, the positive pressure purging operation, wiping operation and flushing operation are performed on one side of the reciprocal movement path of the print head during purging. During non-printing, the nozzle surface of the print head is covered with the cap on the other side of the reciprocal movement path of the print head.

According to this embodiment, it is possible to perform the function of temporarily keeping the compressed air not only in a charge tank corresponding to an ink cartridge to be purged and the air channel (space) corresponding to the charge tank, but also in the charge tanks and space of air channels corresponding to other ink cartridges. Thus, there is a further advantage in reducing the charge tank size.

According to this embodiment, it is possible to integrally construct each charge tank and a casing constituting an ink cartridge corresponding to the charge tank, and it is possible to omit a charge tank as an independent part. Moreover, since the tank capacity required when using a single common charge tank is divided among a plurality of charge tanks and the capacity of the air channel may also be utilized, there is no need to provide a very large ink cartridge.

According to this embodiment, when increasing the pressure in each of the charge tanks, it is possible to increase the pressure to a certain pressure within an almost uniform time regardless of the flow resistance of the ink channel corresponding to each charge tank.

According to this embodiment, by only controlling the pressure applying electromagnetic valve and the atmospheric air release electromagnetic value without using a switching mechanism such as a switching valve, it is possible to perform positive pressure purging at a desired pressure.

According to this embodiment, it is possible to perform optimum positive pressure purging according to the degree of print defect, thereby avoiding wasteful ink consumption.

According to this embodiment, by changing the amount of compressed air to be kept in the charge tank and the air channel, it is possible to simply and easily perform optimum positive pressure purging according to the degree of print defect.

As this description may be embodied in several forms without departing from the spirit of essential characteristics thereof, the present embodiment is therefore illustrative and not restrictive, since the scope is defined by the appended claims rather than by the description preceding them, and all changes that fall within metes and bounds of the claims, or equivalence of such metes and bounds are therefore intended to be embraced by the claims.

What is claimed is:

1. An inkjet printer comprising:

a print head having a plurality of nozzles;

a plurality of ink cartridges storing inks of different colors, respectively, to be supplied to said print head; and a pressure applying section for applying pressure in an ejecting direction to the inks in the nozzles of said print head by supplying compressed air to said ink cartridges;

wherein said pressure applying section comprises:

a pump for supplying compressed air to said ink cartridges through an air channel extending between said ink cartridges and said pump; and a charge tank provided in said air channel, for temporarily keeping the compressed air; and wherein, after increasing pressure in said plurality of ink cartridges, said charge tank, and said air channel simultaneously by the supply of compressed air from said pump, the compressed air is released to said print head and the pressure is applied to the inks in the nozzles of said print head;

wherein said pressure applying section further comprises an atmospheric air release valve provided for said charge tank or said air channel, a pressure applying valve provided in an ink channel between said print head and each of said ink cartridge, and a controller for controlling said pump, said atmospheric air release valve, and said pressure applying valve; and wherein said controller performs control so that, after increasing pressure in said ink cartridges, charge tank, and air channel by driving said pump for a certain time, said pressure applying valve is opened to apply the pressure to the inks in the nozzles of said print head, said atmospheric air release valve is opened after elapse of a certain time, and the compressed air in said charge tank is released to atmosphere.

2. The inkjet printer according to claim 1;

wherein said print head moves reciprocally in a direction orthogonal to a recording medium feeding direction during printing;

wherein a wiper for wiping a nozzle surface, on which the nozzles are formed, of said pint head and a flushing tank for ejecting excess ink are provided on one side of a reciprocal movement path; and wherein a cap for covering the nozzle surface during non-printing is provided on the other side.

3. The inkjet printer according to claim 1;

wherein a plurality of said charge tanks are provided for said ink cartridges, respectively.

4. The inkjet printer according to claim 3;

wherein each of said charge tanks has a tank capacity which is set according to a flow resistance in an ink channel between said print head and said ink cartridge corresponding to said each charge tank.

5. The inkjet printer according to claim 3;

wherein each of said charge tanks is constructed integrally with a casing constituting said each ink cartridge.

6. The inkjet printer according to claim 1;

wherein said controller controls said pressure applying section according to a degree of print defect so as to change a magnitude of pressure to be applied to the inks in the nozzles of said print head.

7. The inkjet printer according to claim 6;

wherein said controller changes the magnitude of the pressure by changing an amount of compressed air to be kept in said ink cartridges, said charge tank and said air channel.

8. The inkjet printer according to claim 1;

wherein said pressure applying section is configured to increase pressure in said plurality of ink cartridges to the same pressure by supplying compressed air from said pump.

9. An inkjet printer comprising:

a print head having a plurality of nozzles;

a plurality of ink cartridges storing inks of different colors, respectively, to be supplied to said print head; and a pressure applying section for applying pressure in an ejecting direction to the inks in the nozzles of said print head by supplying compressed air to said ink cartridges;

wherein said pressure applying section comprises:

a pump for supplying compressed air to said ink cartridges through an air channel extending between said ink cartridges and said pump; and a charge tank provided in said air channel, for temporarily keeping the compressed air; and wherein, after increasing pressure in said plurality of ink cartridges, said charge tank, and said air channel simultaneously by the supply of compressed air from said pump, the compressed air is released to said print head and the pressure is applied to the inks in the nozzles of said print head;

wherein said pressure applying section further comprises an atmospheric air release valve provided for said charge tank or said air channel, a pressure applying valve provided in an ink channel between said print head and each of said ink cartridges, and recovery control means for controlling said pump, said atmospheric air release valve, and said pressure applying valve; and wherein said recovery control means performs control so that, after increasing the pressure in said ink cartridges, charge tanks and air channel by driving said pump for a certain time, said pressure applying valve is opened to apply the pressure to the inks in the nozzles of said print head, said atmospheric air release valve is opened after elapse of a certain time, and the compressed air in said charge tank is released to atmosphere.

10. The inkjet printer according to claim 9;

wherein said recovery control means controls said pressure applying section according to a degree of print defect so as to change a magnitude of pressure to be applied to the inks in the nozzles of said print head.

11. The inkjet printer according to claim 10;

wherein said recovery control means changes the magnitude of the pressure by changing an amount of compressed air to be kept in said ink cartridges, said charge tank, and said air channel.

12. A method of controlling an inkjet printer comprising: a print head having a plurality of nozzles; a plurality of ink cartridges storing inks of different colors, respectively, to be supplied to said print head; a pump for supplying compressed air to said ink cartridges through an air channel extending between said ink cartridges and said pump; and a charge tank provided in said air channel, for temporarily keeping the compressed air; said method comprising the steps of:

increasing pressure in said plurality of ink cartridges, said charge tank, and said air channel simultaneously by the supply of compressed air from said pump; and applying the pressure to the inks in the nozzles of said print head by releasing the compressed air to said print head;

wherein said inkjet printer further comprises an atmospheric air release valve provided for said charge tank or said air channel, a pressure applying valve provided in an ink channel between said print head and each of said ink cartridge, and a controller for controlling said pump, said atmospheric air release valve, and said pressure applying valve; and wherein said controller performs control so that, after increasing pressure in said ink cartridges, charge tank, and air channel by driving said pump for a certain time, said pressure applying valve is opened to apply the pressure to the inks in the nozzles of said print head, said atmospheric air release valve is opened after elapse of a certain time, and the compressed air in said charge tank is released to atmosphere.

* * * * *